US008122573B2

(12) United States Patent
Takazawa

(10) Patent No.: US 8,122,573 B2
(45) Date of Patent: Feb. 28, 2012

(54) THIN SLIDER

(75) Inventor: Shigeyoshi Takazawa, Irvine, CA (US)

(73) Assignee: YKK Corporation (JP)

( * ) Notice: Subject to any disclaimer, the term of this patent is extended or adjusted under 35 U.S.C. 154(b) by 496 days.

(21) Appl. No.: 12/349,723

(22) Filed: Jan. 7, 2009

(65) Prior Publication Data

US 2010/0170067 A1 Jul. 8, 2010

(51) Int. Cl.
*A44B 19/30* (2006.01)

(52) U.S. Cl. ..... 24/418; 24/420; 24/421; 24/423; 24/424

(58) Field of Classification Search ..... 24/420, 24/421, 423, 424, 436, 385, 416, 418
See application file for complete search history.

(56) References Cited

U.S. PATENT DOCUMENTS

| | | | | | |
|---|---|---|---|---|---|
| D114,268 | S | | 4/1939 | Poux | |
| D114,269 | S | | 4/1939 | Poux et al. | |
| 2,166,905 | A | | 6/1939 | Poux | |
| 2,172,214 | A | * | 9/1939 | Marinsky | 24/424 |
| D117,823 | S | | 11/1939 | Poux | |
| 2,261,132 | A | | 11/1941 | Poux | |
| 2,277,506 | A | | 3/1942 | Beckwith et al. | |
| 2,450,550 | A | * | 10/1948 | Griffin et al. | 24/424 |
| 2,494,249 | A | | 1/1950 | Krupp | |
| 2,839,806 | A | * | 6/1958 | Moser | 24/424 |
| 3,255,505 | A | * | 6/1966 | Moser | 24/423 |
| 3,729,781 | A | * | 5/1973 | Fukuroi | 24/424 |
| 3,919,745 | A | * | 11/1975 | Dupon | 24/424 |
| 4,069,555 | A | * | 1/1978 | Toepelt | 24/424 |
| 4,667,376 | A | * | 5/1987 | Ishii et al. | 24/421 |
| 4,679,281 | A | * | 7/1987 | Ishii et al. | 24/422 |
| 4,829,638 | A | * | 5/1989 | Ishii | 24/421 |
| 4,982,479 | A | * | 1/1991 | Oda | 24/424 |
| 5,068,950 | A | * | 12/1991 | Yuki | 24/429 |

(Continued)

FOREIGN PATENT DOCUMENTS

| | | |
|---|---|---|
| GB | 734469 | 8/1955 |

(Continued)

*Primary Examiner* — Robert J Sandy
*Assistant Examiner* — Abigail E Morrell
(74) *Attorney, Agent, or Firm* — Kilpatrick Townsend & Stockton LLP

(57) ABSTRACT

There is provided a thin slider for a slide fastener with an automatic locking mechanism with a locking pawl while having an excellent design property and operability.
The thin slider according to the present invention includes a locking pawl journaled by a slider body and a resilient member accommodated in a connecting post. The locking pawl is urged in such a first rotation direction that its pawl portion is inserted into an element guide passage of the slider body by the resilient member. The upper blade of the slider body includes a first upper blade connected to the connecting post and a second upper blade which is attached slidably onto the first upper blade. The second upper blade has a thin second upper blade main body and an operating piece drooping from the front end portion of the second upper blade main body. A first operating portion for pressing the first projecting piece in a second rotation direction for pulling the pawl portion out of the element guide passage when the second upper blade is slid backward is disposed on the inner face of the operating piece, and a second operating portion for pressing the second projecting piece in the second rotation direction when the second upper blade is slid forward is disposed on the side of the sliding face of the second upper blade main body.

10 Claims, 8 Drawing Sheets

U.S. PATENT DOCUMENTS

| | | | | |
|---|---|---|---|---|
| 5,400,481 | A * | 3/1995 | Oda | 24/424 |
| 5,611,121 | A * | 3/1997 | Akeno et al. | 24/423 |
| 5,848,455 | A * | 12/1998 | Ikehara et al. | 24/422 |
| 5,864,928 | A * | 2/1999 | Matsushima | 24/421 |
| 5,956,819 | A * | 9/1999 | Terasaki et al. | 24/432 |
| 5,996,188 | A * | 12/1999 | Yaguramaki et al. | 24/424 |
| 6,499,200 | B1 * | 12/2002 | Yamagishi et al. | 24/429 |
| 7,219,402 | B2 * | 5/2007 | Yamazaki | 24/429 |
| 7,225,509 | B2 * | 6/2007 | Bernasconi | 24/422 |
| 7,360,285 | B2 * | 4/2008 | Takazawa | 24/423 |
| 7,603,753 | B2 * | 10/2009 | Baker | 24/429 |
| 2003/0056342 | A1 * | 3/2003 | Iwase et al. | 24/421 |
| 2005/0246872 | A1 * | 11/2005 | Takazawa | 24/429 |

FOREIGN PATENT DOCUMENTS

| | | |
|---|---|---|
| JP | D566844 | 12/1981 |
| JP | D1314704 | 11/2007 |

* cited by examiner

THIN SLIDER

BACKGROUND OF THE INVENTION

1. Field of the Invention

The present invention relates to a thin slider having an excellent design property for use in a slide fastener and more particularly to a thin slider having an automatic locking mechanism with a locking pawl.

2. Description of the Related Art

Conventionally, a slide fastener is attached to an opening in order to open or close the opening in clothes or bags. As one of the sliders for use in such a slide fastener, there has been known, for example, a thin slider having an excellent design property as described in Japanese Design Registration No. 1314704.

As shown in FIG. 10, a thin slider 71 described in Japanese Design Registration No. 1314704 is configured simply of a slider body 76 in which projecting tab attaching portions 75 are disposed on the right and left side faces of the upper blade 72, and a tab 77 pivoted on the right and left tab attaching portions 75, while the front end portions of upper and lower blades 72, 73 are connected to a connecting post. Reduction in thickness of the slider in the vertical direction is achieved by pivoting the tab 77 on the right and left side faces of the upper blade 72 via a tab attaching portion 75.

On the other hand, as a conventional slider for slide fastener, a slider of a type having automatic locking mechanism as disclosed in, for example, U.S. Pat. No. 2,839,806 has been generally known.

A slider 100 described in U.S. Pat. No. 2,839,806, as shown in FIGS. 11 and 12, includes a slider main body 101, a U-shaped bracket 102, a locking pawl 114 supported by the slider main body 101 and a tab 127 attached slidably along the bracket 102.

In the slider main body 101 in U.S. Pat. No. 2,839,806, the front end portions of the upper and lower blades 103, 104 are connected to the connecting post 105 and a hole portion 124 for accommodating a spring 125 for urging the locking pawl 114 is formed in the lower end portion of the connecting post 105. In the central portion in the right and left direction of the slider main body 101, a rib 110 projecting upward from the upper blade and a forked member 111 extending forward of the upper and lower blades 103, 104 are formed integrally. T-shaped members 106, 107 for engaging the U-shaped bracket 102 are erected at the rear mouth end portion of the rib 110.

The U-shaped bracket 102 has a wall portion 130 formed into a U shape and a holding groove portion which is disposed inside the wall portion 130 in order to hold the proximal portion 128 of the tab slidably. The wall portion 130 has an upper leg portion, a lower leg portion and a curved portion for connecting the upper and lower leg portions. Each front end of the upper and lower leg portions has a T-shaped groove portion to which each of the T-shaped members 106, 107 is attached. The upper leg portion of the bracket 102 has a hole portion 121 and a projecting portion 122 is provided on the curved portion adjacent the lower leg portion.

The locking pawl 114 has a pawl lever portion 115 extending backward from a journaling portion 118 which is journaled by the slider main body 101, a first lever portion 126 disposed below the journaling portion 118 and a second lever portion 123 which is disposed above the journaling portion 118 and passes through the hole portion 121 of the U-shaped bracket 102, thereby presenting a substantially T-shaped side view. A pawl portion 117 which can be inserted into/pulled out of an element guide passage 116 in the slider main body 101 is projected from the rear end of the pawl lever portion 115 of the locking pawl 114. The first lever portion 126 of the locking pawl is urged by a spring 125 accommodated in a connecting post 105 of the slider main body 101 in such a direction that the pawl portion 117 of the locking pawl 114 is inserted into the element guide passage 116.

If the slider 100 in U.S. Pat. No. 2,839,806 having such a configuration is employed for a slide fastener, when the slider is locked relative to the element rows without being slid, the locking pawl is urged by the spring 125 as shown in FIG. 12 so that the pawl portion 117 of the locking pawl 114 is inserted into the element guide passage 116. Consequently, the pawl portion 117 of the locking pawl 114 is engaged with the element rows passed through the element guide passage 116 so as to hold the locking position of the slider 100 stably.

For example, if the slider is slid in a direction for decoupling the element rows, the tab 127 is pulled backward of the slider 100. Consequently, the proximal end portion 128 of the tab 127 is moved backward along a holding groove of the U-shaped bracket 102 and comes into contact with an abutment portion 129 of the U-shaped bracket 102. Further, if the tab 127 is pulled backward in a state in which it keeps contact with the abutment 129, the U-shaped bracket 102 is pulled by the proximal end portion 128 of the tab 127 so that the same U-shaped bracket 102 is moved backward of the slider main body 101.

When the U-shaped bracket 102 is moved backward, the projecting portion 122 of the U-shaped bracket 102 presses the first lever portion 126 of the locking pawl 114 so as to rotate the locking pawl 114 resisting an urging force of the spring 125. As a result, the pawl portion 117 of the locking pawl 114 is pulled out of the element guide passage. Then, engaging between the pawl portion 117 and the element row is released to enable the slider 100 to slide smoothly along the element rows.

When an operation of the tab is stopped after the slider 100 is slid to a predetermined position of the element row, the U-shaped bracket 102 is moved to its original position by a force by which the spring 125 urges the locking pawl 114, so that the pawl portion 117 of the locking pawl 114 is inserted into the element guide passage 116. Consequently, the slider 100 can be held at the locking position.

On the other hand, for example, when the slider 100 is slid in a direction for coupling the element rows, the tab 127 is pulled forward of the slider 100 and consequently, the proximal end portion 128 of the tab 127 is moved forward along the holding groove in the U-shaped bracket 102 so that it comes into contact with a wall portion 130 in the center of its curved portion. Further, if the tab 127 is pulled forward while keeping contact with the wall portion 130, the U-shaped bracket 102 is pulled by the proximal end portion 128 of the tab 127, so that the U-shaped bracket 102 is moved forward of the slider main body 101.

Consequently, the side wall face 131 disposed in the hole portion 121 of the U-shaped bracket 102 presses the second lever portion 123 of the locking pawl 114 so as to rotate the locking pawl 114 resisting the urging force of the spring 125 and consequently, the pawl portion 117 of the locking pawl 114 is pulled out of the element guide passage 116. Therefore, the slider 100 can be slid along the element rows smoothly.

According to the slider of U.S. Pat. No. 2,839,806, when the tab 127 of the slider 100 is not operated, the locking state of the slider 100 can be maintained by the locking pawl 114 stably. Further, if the tab 127 is operated to slide the slider 100, the pawl portion 117 of the locking pawl 114 can be pulled out of the element guide passage 116 by operating the tab 127, thereby smoothly sliding the slider 100.

The conventional thin slider 71 (see FIG. 10) as described in Japanese Design Registration No. 566844 is configured as a free slider having no automatic locking mechanism because its design property is taken as more important than its functionality. However, in recent years, as clothes, bags and the like equipped with the slide fastener have become multifunctional and applications of the slide fastener are expanded, the slide fasteners have been demanded to be provided with various functions. For example, the above-mentioned thin slider has been demanded to be equipped with the automatic locking mechanism.

To meet such a demand, it can be considered to employ the automatic locking mechanism described in U.S. Pat. No. 2,839,806 for the thin slider described in Japanese Design Registration No. 566844. In this case, it is necessary to provide the slider body of the thin slider with the locking pawl 114 or the spring 125 described in U.S. Pat. No. 2,839,806 and at the same time, with the U-shaped bracket 102 for pressing the first and second lever portions 126, 123 of the locking pawl 114 when the tab is operated.

However, if the thin slider is provided with the locking pawl 114 or the U-shaped bracket 102 described in U.S. Pat. No. 2,839,806, not only is the thickness of the thin slider in the vertical direction increased, but also the design property is lost, thereby producing such a problem that advantages of the thin slider are eliminated.

According to the slider 100 having the automatic locking mechanism in U.S. Pat. No. 2,839,806, the slider 100 cannot be slid along the element rows until the proximal end portion 128 of the tab 127 is moved along the holding groove in the U-shaped bracket 102 by operating the tab 127 so as to bring the proximal end portion 128 into contact with the abutment portion 129 of the U-shaped bracket 102 or the wall portion 130 in the center of the curved portion. Therefore, the slider 100 in U.S. Pat. No. 2,839,806 has such a drawback that the sliding operation of the slider is delayed with respect to the operation of the tab as compared with the thin slider in Japanese Design Registration No. 566844, whereby leaving a room for improvement in terms of the operability of the slider 100.

SUMMARY OF THE INVENTION

The present invention has been achieved in views of the above-described problems and an object of the invention is to provide a thin slider for a slide fastener equipped with an automatic locking mechanism with the locking pawl while having an excellent design property and operability.

To achieve the above-described object, the present invention provides a thin slider for a slide fastener comprising: a slider body in which front end portions of the upper and lower blades are connected by a connecting post, a Y-shaped element guide passage is provided between the upper and lower blades and a tab attaching portion is disposed on each of the right and left side faces of the upper blade; and a tab having an arm portion pivoted on the right and left tab attaching portions and a tab main body portion formed integrally with the arm portion, the thin slider further comprising a locking pawl which is journaled by the slider body and a resilient member accommodated in the connecting post, wherein the locking pawl comprises: a pawl lever portion which is extended backward from a journaling portion which serves as a rotation shaft and in which a pawl portion capable of being inserted into and pulled out of the element guide passage are provided projectingly at a rear end portion thereof, a first projecting piece disposed below the journaling portion; and a second projecting piece disposed above the journaling portion, the first projecting piece being urged in a first rotation direction for inserting the pawl portion into the element guide passage by the resilient member, the upper blade is connected to the connecting post and comprises a first upper blade having a guide portion disposed on a top face thereof in the back and forth direction and a second upper blade which is attached slidably to the first upper blade along the guide portion, and the second upper blade comprises a second upper blade main body in a thin plate shape disposed on a top face of the first upper blade and an operating piece drooping from the front end portion of the second upper blade along the connecting post, wherein a first operating portion for pressing the first projecting piece in a second rotation direction for pulling the pawl portion out of the element guide passage when the second upper blade is slid backward is disposed on an inner face of the operating piece, and a second operating portion for pressing the second projecting piece in the second rotation direction when the second upper blade is slid forward is disposed on a side of the sliding face of the second upper blade main body.

In the thin slider according to the present invention, preferably, the resilient member is disposed on a side of the upper blade with respect to an inner face of the lower blade.

Preferably, the slider body comprises: a pawl accommodating groove which is provided concavely in a top face of the first upper blade so as to accommodate the locking pawl; and a pawl hole which is bored in a rear end of the pawl accommodating groove so as to allow the pawl portion to pass through, the bottom face portion of the pawl accommodating groove having a declined face which is declined toward the pawl hole.

In this case, preferably, a height position in a vertical direction of part of the bottom face portion is at a same height position as a rotation shaft center of the locking pawl or at a height position above the rotation shaft center. Preferably, the locking pawl has a declined slope portion corresponding to the declined slope face of the pawl accommodating groove. Further, preferably, the bottom face portion of the pawl accommodating groove is extended toward a rear mouth side with respect to the connecting post.

In the thin slider of the present invention, preferably, the lower face of the slider body is formed in a flat plane. Further, preferably, the second upper blade has a holding tongue extended backward from a lower end of the operating piece, and an attaching groove to which the holding tongue is attached slidably is provided concavely in a lower face of the lower blade.

Further, in the thin slider of the present invention, preferably, the guide portion includes: a proximal portion erected from a top face of the first upper blade and an engaging piece extended outward in a right and left direction from the proximal portion, and the lower face of the second upper blade contains a guide groove having a T-shaped section along a back and forth direction thereof, the guide groove allowing the guide portion to be attached thereto. In this case, preferably, a concave groove parallel to the guide groove is provided concavely in a groove bottom face portion of the guide groove.

The thin slider according to the present invention has a slider body in which tab attaching portions are attached on the right and left side faces of a upper blade, a tab pivoted on the tab attaching portions, a locking pawl journaled by the slider body and a resilient member accommodated in the connecting post. The locking pawl has a pawl lever portion which is extended backward from the journaling portion while a pawl portion is projected from the rear end portion, a first projecting piece disposed below the journaling portion and a second projecting piece disposed above the journaling portion and the first projecting piece is urged in a first rotation direction by the resilient member.

Consequently, if the slider fastener is configured using the thin slider of the present invention, when the tab of the slider is not operated, the locking pawl is urged by the resilient member so that the pawl portion of the locking pawl is inserted into the element guide passage of the slider body so as to hold the slider at a locking position on the element rows.

Further, the upper blade of the thin slider has a first upper blade having a guide portion on its top face side and a second upper blade which is attached slidably along a guide portion. The second upper blade has a sheet-like second upper blade main body and an operating piece drooping from the front end portion of the second upper blade main body. The inner face of the operating piece has a first operating portion for pressing the first projecting piece in the second rotation direction when the second upper blade is slid backward. Further, a second operating portion for pressing the second projecting piece when the second upper blade is slid forward is disposed on the side of the sliding face of the second upper blade main body.

Consequently, when the thin slider is slid in the direction for decoupling or coupling the element rows by operating the tab, the second upper blade is pulled by the tab so that the first upper blade is slid backward or forward. At this time, the first operating portion and the second operating portion disposed on the second upper blade press the first projecting piece or the second projecting piece of the locking pawl in the second rotation direction so as to pull the pawl portion out of the element guide passage. As a result, the thin slider can be slid smoothly along the element rows.

That is, because the first and second operating portions are provided on the second upper blade attached slidably onto the first upper blade, the thin slider according to the present invention can be equipped with an automatic locking mechanism with the locking pawl without being provided with the U-shaped bracket 102 as mentioned in U.S. Pat. No. 2,839,806, for example. Further, in the present invention, because the tab is pivoted on the second upper blade, the second upper blade can be slid directly by operating the tab. Consequently, this prevents the sliding operation of the slider to be delayed with respect to the operation of the tab, thereby not reducing the operability of the slider. In this way, the thin slider according to the present invention can possess the automatic locking mechanism without increasing the thickness in the vertical direction as described in U.S. Pat. No. 2,839,806, thereby securing excellent functionality, sliding performance and design property.

In the thin slider of the present invention, the resilient member is disposed above the inner face of the lower blade. In the slider 100 in U.S. Pat. No. 2,839,806,for example, the spring 125 is accommodated at a position below the inner face of the lower blade 104 of the connecting post 105. Thus, the strengths of the lower blade and the connecting post are difficult to secure if no U-shaped bracket 102 is provided.

Contrary to this, in the thin slider of the present invention, a resilient member is disposed on the side of the upper blade with respect to the inner face of the lower blade. Consequently, the strengths of the lower blade and the connecting post can be secured easily without a provision of the U-shaped bracket and the resilient member can be accommodated stably. Thus, the thin slider enables the automatic locking mechanism to function stably in a long period.

In the thin slider of the present invention, the slider body has a pawl accommodating groove which is provided concavely in the top face of the first upper blade so as to accommodate the locking pawl and a pawl hole which is bored in the rear end of the pawl accommodating groove, allowing the pawl portion to pass through and the bottom face portion of the pawl accommodating groove has a declined slope face which is declined toward the pawl hole from a front end side of the upper blade.

Consequently, a space for swinging the pawl lever portion of the locking pawl vertically within the pawl accommodating groove can be secured easily, so that the pawl portion of the locking pawl can be inserted securely into the element guide passage when the tab is not operated. Further, when the tab is operated to slide the second upper blade, the pawl portion of the locking pawl can be pulled out of the element guide passage smoothly.

In this case, the height position in the vertical direction of part of the bottom face portion of the pawl accommodating groove is set at the same height position as the rotation shaft center of the locking pawl or above the same rotation shaft center. Consequently, even if the resilient member is disposed on the side of the upper blade with respect to the inner face of the lower blade as described above, the strengths of the first upper blade and the connecting post can be secured easily, thereby functioning the automatic locking mechanism stably in a long period.

The locking pawl has a declined slop portion corresponding to the declined slop face of the pawl accommodating groove. Consequently, the locking pawl can be rotated within the pawl accommodating groove having the declined slop face on its bottom face smoothly and effectively, thereby functioning the automatic locking mechanism securely.

Further, the bottom face of the pawl accommodating groove is extended toward the rear mouth with respect to the connecting post. Consequently, when the pawl portion of the locking pawl is inserted into the element guide passage, the locking pawl can be supported by the bottom face of the pawl accommodating groove at a portion as near the pawl portion as possible. Consequently, the posture of the locking pawl when the tab is not operated can be stabilized and further, the position where the pawl portion is inserted into the element guide passage can be stabilized.

Therefore, when the slide fastener is configured using the slider of the present invention, when the tab is not operated, the pawl portion of the element guide passage is engaged with the element rows stably so as to hold the slider at a locking position of the element row securely. Further, the posture of the locking pawl is stabilized, so that when the tab is operated to slid the slider, the first operating portion or the second operating portion of the second upper blade can press the first projecting piece or the second projecting piece securely, so that the pawl portion can be pulled out of the element guide passage smoothly.

According to the present invention, the lower face of the slider body is formed in a flat plane. For example, in the case where the U-shaped bracket 102 is disposed so that it is projected to the side of the lower face of the lower blade 104 like the slider 100 in U.S. Pat. No. 2,839,806, for example, if the slide fastener is configured using the slider 100, the slider is likely to collide with or be caught by another member when the slider 100 is slid, whereby the operability of the slider 100 is dropped.

Contrary to this, if the slide fastener is configured using the slider of the present invention, the lower face of the slider can be prevented from colliding with or being caught by another member because the lower face of the slider body is formed in a flat plane like the present invention, thereby sliding the slider smoothly. Further, if the bottom face of the slider body is formed in the flat plane, the appearance and tactile feeling of the slider can be improved.

Further, in the present invention, the second upper blade has the holding tongue extended backward from the lower end of the operating piece and the lower face of the lower blade is concavely provided with an attaching groove for attaching the holding tongue slidably. Consequently, the attaching strength of the second upper blade to the first upper blade can be improved, so as to form the slider of the present invention more rigidly.

Further, the guide portion has a proximal portion erected from the top face of the first upper blade and an engaging piece extended outward in the right and left direction from the top end of the proximal portion. The lower face of the second upper blade contains a guide groove having a T-shaped section which allows the guide portion to be attached thereto along the back and forth direction. Accordingly, the second upper blade can be slidably attached to the first upper blade securely.

In this case, a concave groove parallel to the guide groove is provided concavely in the groove bottom face portion of the guide groove. Consequently, the rotation space of the locking pawl can be secured more effectively, thereby functioning the automatic locking mechanism securely. Further, because the concave groove is provided in the groove bottom face of the guide groove, assembly work of the thin slider can be carried out easily.

DESCRIPTION OF THE PREFERRED EMBODIMENTS

Hereinafter, the embodiments of the present invention will be described in detail with reference to the accompanying drawings with examples.

First Embodiment

Figure 1:
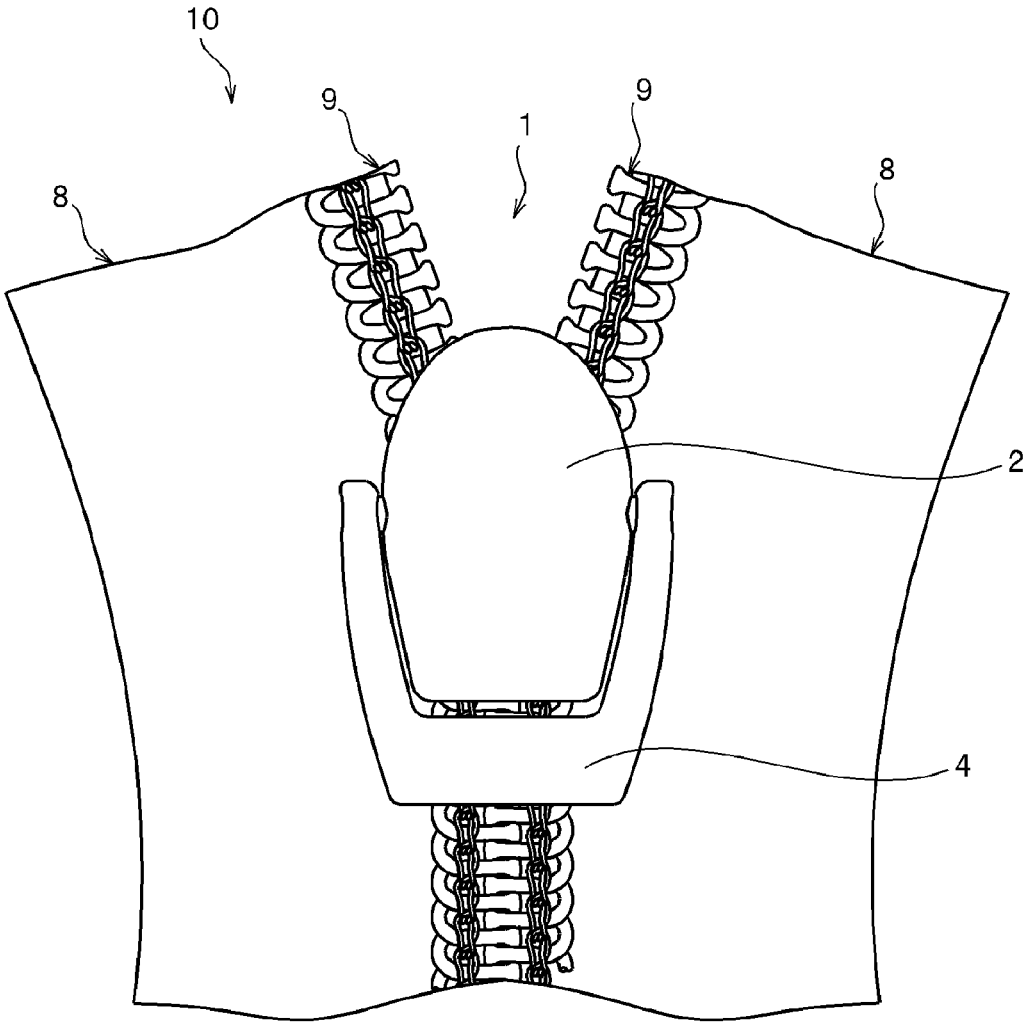
FIG. 1 is a front view of a slide fastener configured by using a thin slider of a first embodiment.
Figure 2:
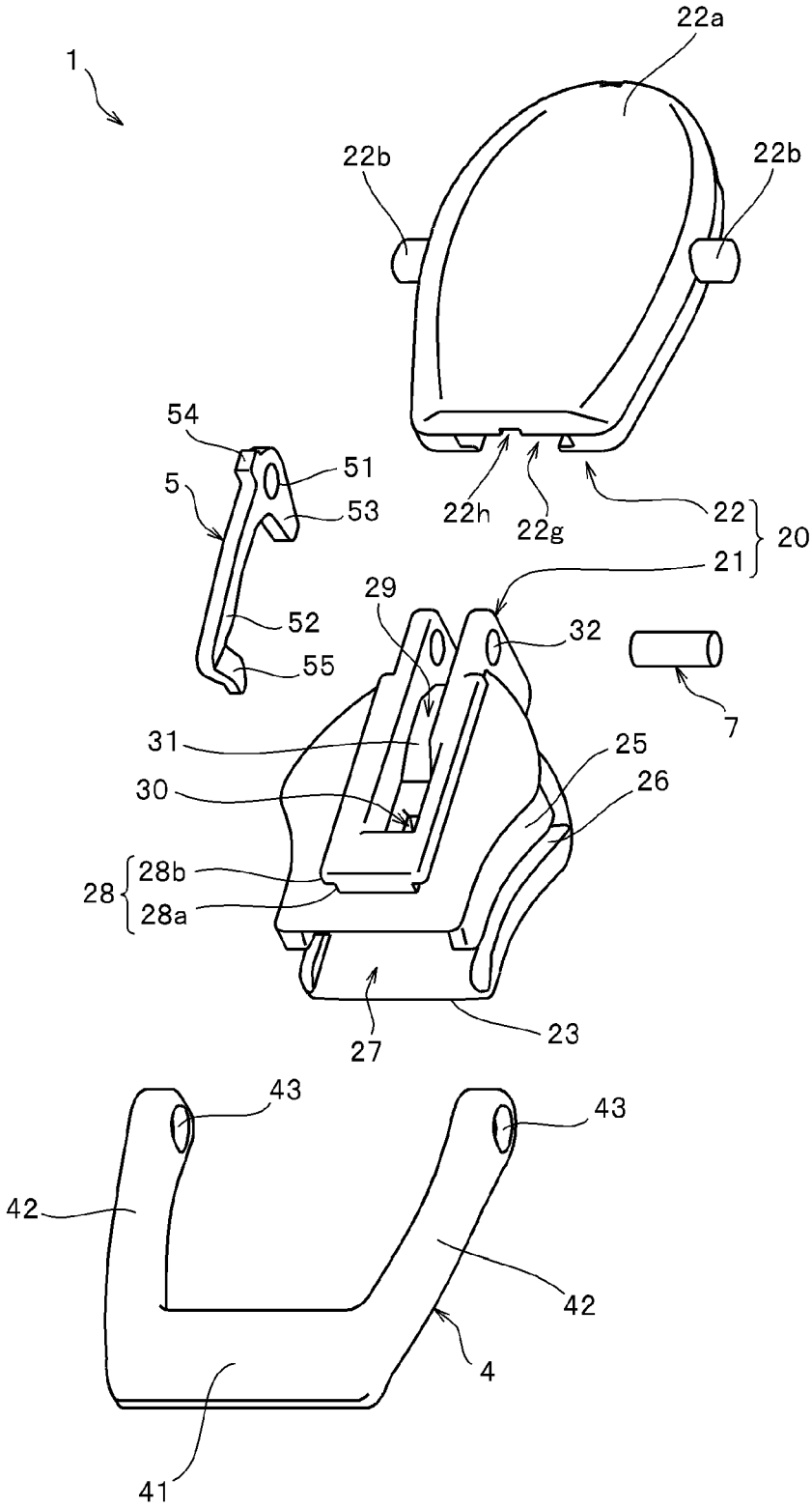
FIG. 2 is a perspective view showing a state in which components configuring the thin slider are separated.
Figure 3:
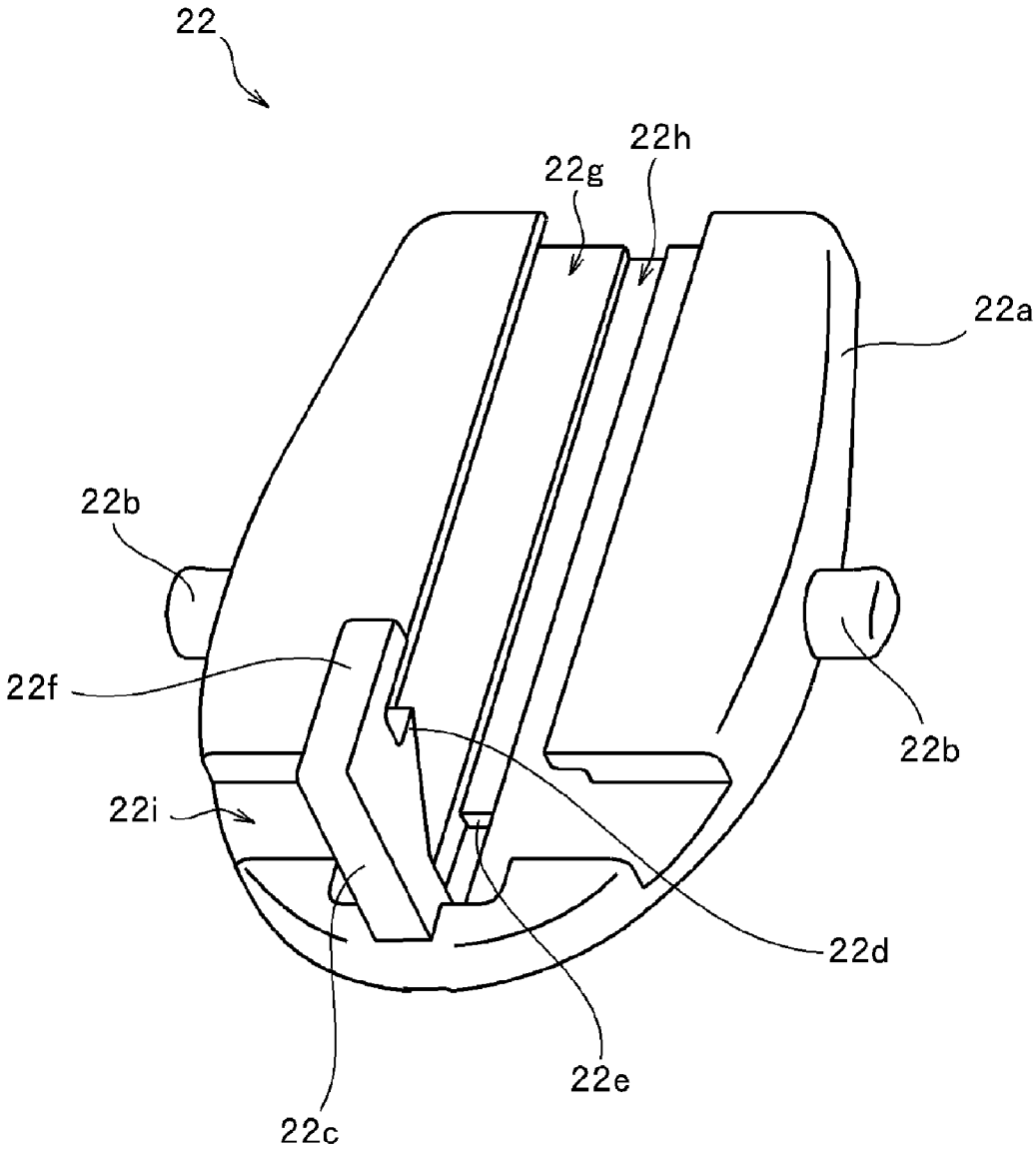
FIG. 3 is a perspective view of a second upper blade as viewed from its sliding face for use in the thin slider.
Figure 4:
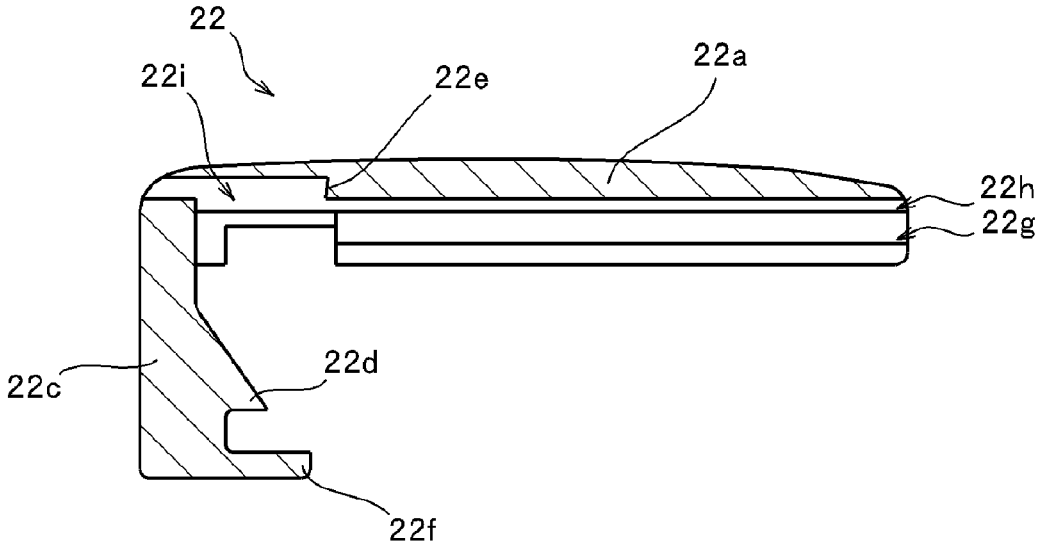
FIG. 4 is a longitudinal sectional view of the second upper blade.
Figure 5:
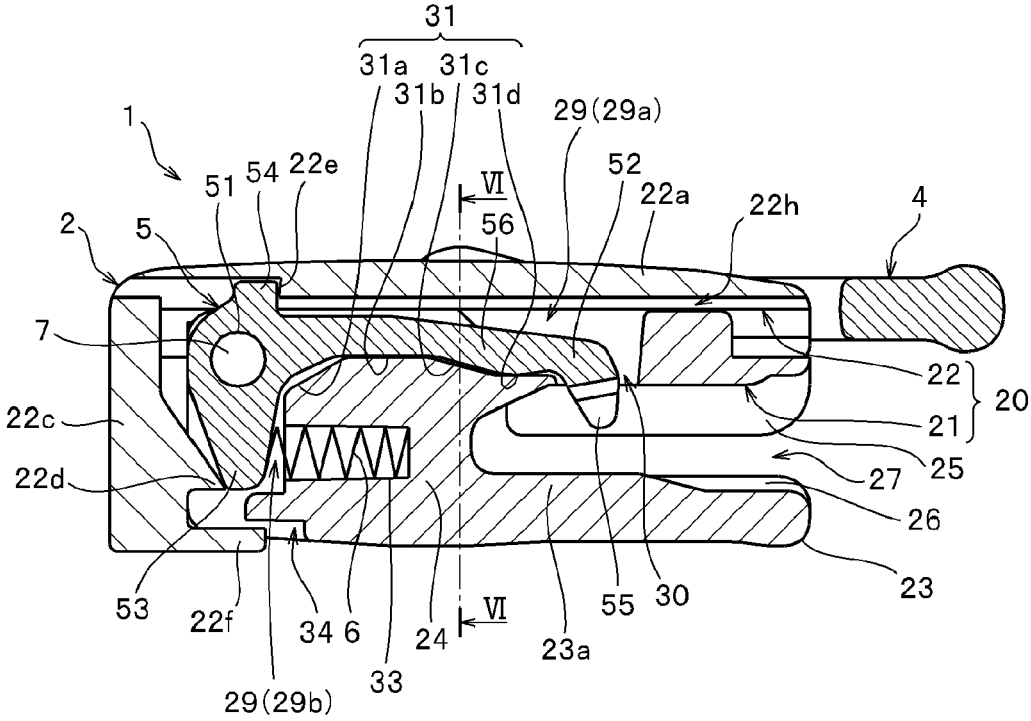
FIG. 5 is a longitudinal sectional view showing a state in which a tab of the thin slider is not operated.
Figure 6:
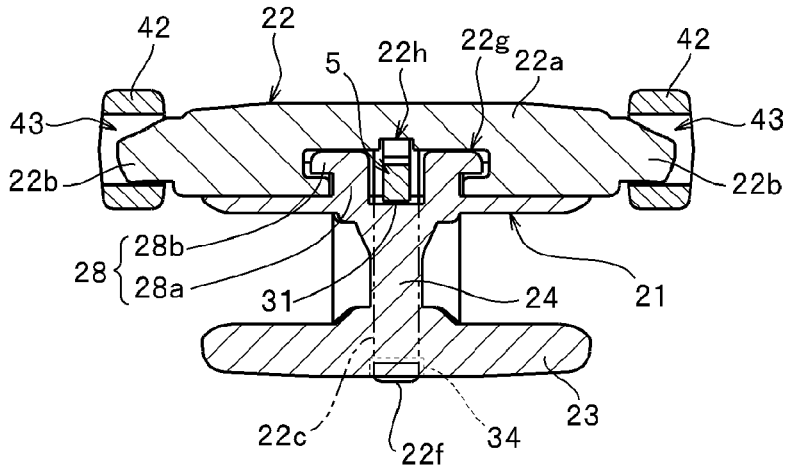
FIG. 6 is a sectional view taken along the line VI-VI of FIG. 5.

FIG. 1 is a front view of a slide fastener configured by using a thin slider of the first embodiment. FIG. 2 is a perspective view showing a state in which components which configure the thin slider are separated, FIG. 3 is a perspective view of a second upper blade as viewed from its sliding face for use in the thin slider and FIG. 4 is a longitudinal sectional view of the second upper blade. FIG. 5 is a longitudinal sectional view showing a state in which a tab of the thin slider is not operated and FIG. 6 is a sectional view taken along the line VI-VI of FIG. 5.

In the thin slider according to the present invention, the direction in which the slider slides in order to couple the element rows is assumed to be forward and the direction in which the slider slides in order to decouple the element rows is assumed to be backward. A direction perpendicular to the upper and lower blades is defined as a vertical direction and a direction parallel to the upper and lower blades and perpendicular to the slider sliding direction is defined as a right and left direction.

The thin slider 1 according to the first embodiment is used in a slide fastener 10 having coil-like element rows 9 as shown in FIG. 1. By sliding the thin slider 1 along the element rows 9, the right and left element rows 9 are coupled and decoupled. In the meantime, the thin slider 1 according to the present invention is not limited to use in the slide fastener 10 having the coil-like element rows 9 as shown in FIG. 1, but may be applied to, for example, a slide fastener having zig-zag-like element rows or a slide fastener of a type in which a plurality of individual fastener elements are provided in line on a fastener tape by injection molding.

As shown in FIGS. 2 and 5, the thin slider 1 of this first embodiment includes a slider body 2, a tab 4 pivoted to the slider body 2, a locking pawl 5 supported by the slider body 2 via a pin 7, and a resilient member 6 which is accommodated in the slider body 2 in order to urge the locking pawl 5. In this case, the slider body 2 and the tab 4 are produced by die casting using metal material such as aluminum alloy and zinc alloy. The locking pawl 5 is produced by pressing or die-casting using metal material such as stainless and copper alloy.

The slider body 2 of the first embodiment includes an upper blade 20, a lower blade 23 and a connecting post 24 for connecting the front ends of the upper and lower blades 20, 23. An upper flange 25 is provided on each of the right and left sides of the upper blade 20 such that it droops in a direction perpendicular to the upper blade 20 and a lower flange 26 is provided on each of the right and left sides of the lower blade 23 such that it is erected in a direction perpendicular to the lower blade 23. Further, the slider body 2 has a shoulder mouth disposed on the right and left sides of the connecting post 24 and a rear mouth disposed at the rear end. A Y-shaped element guide passage 27, which connects the right and left shoulder mouths with the rear mouth, is formed between the upper and lower blades 20, 23.

The upper blade 20 of the slider body 2 has a first upper blade 21 connected to the connecting post 24 and a second upper blade 22 which is attached slidably to the first upper blade 21. According to the first embodiment, the first upper blade 21 is formed into a thin plate and its length in the back and forth direction is set smaller than the second upper blade 22. A guide portion 28 having a base portion 28*a* erected from the top face of the first upper blade 21 and an engaging piece 28*b* extended outward in the right and left direction from the top end of the base portion 28*a* is disposed in the back and forth direction on the top face of the first upper blade 21.

Further, a pawl accommodation groove 29 for accommodating and holding the locking pawl 5 is provided in the first upper blade 21 and the connecting post 24 concavely from the top face of the guide portion 28 and a pawl hole 30 through which a pawl portion 55 described later of the locking pawl 5 can be passed is bored in the rear end portion of the pawl accommodating groove 29. As shown in FIG. 5, the pawl accommodating groove 29 has a first accommodating groove 29*a* formed along the back and forth direction and a second accommodating groove 29*b* formed in the front end portion of the first upper blade 21 along the vertical direction.

According to the first embodiment, the bottom face portion 31 of the first accommodating groove 29*a* is provided such that it is curved continuously from the second accommodating groove 29*b* up to the pawl hole 30. The bottom face portion 31 is extended up to the position on the rear mouth side with respect to the rear end of the connecting post 24. In this case, the bottom face portion 31 has a first bottom face portion 31*a* formed of an inclined slope face which is inclined upward from the second accommodating groove 29*b* side toward the rear mouth side, a second bottom face portion 31*b* which is disposed at the same height position as the rotation shaft center (center of a shaft journaling portion 51 described later) of the locking pawl 5 or above the rotation shaft center, a third bottom face portion 31*c* formed of a declined slope face which is declined from the rear end of the second bottom face portion 31*b* toward the rear mouth, and a fourth bottom face portion 31*d* for supporting the locking pawl 5 on the rear mouth side with respect to the connecting post 24.

The second upper blade 22 has a thin second upper blade main body 22*a* disposed on the top face of the first upper blade 21 and formed in a same size as that of the first upper blade 21 or larger than that, cylindrical tab attaching portions 22*b* projecting from the right and left side faces of the second upper blade main body 22*a*, an operating piece 22*c* drooping from the front end of the second upper blade 22*a* along the connecting post 24 and a holding tongue piece 22*f* extended backward from the lower end of the activating piece 22*c*.

As shown in FIGS. 3 and 5, a first operating portion 22*d* for pressing the locking pawl 5 when the second upper blade 22 is slid backward along the first upper blade 21 is provided projectingly on the inner face of the operating piece 22*c*. A second operating portion 22*e* for pressing the locking pawl 5 when the second upper blade 22 is slid forward along the first upper blade 21 is provided concavely in the sliding face of the second upper blade main body 22*a*.

A guide groove 22*g* having a T-shaped section to which the guide portion 28 provided on the first upper blade 21 can be attached is formed in the sliding face (lower face) of the second upper blade main body 22*a* in the back and forth direction. A first concave groove 22*h* which is narrower than an opening portion of the guide groove 22*g* and parallel to the guide groove 22*g* is provided concavely in the groove bottom face portion of the guide groove 22*g*. According to the first embodiment, a second concave groove 22*i* provided concavely in the right and left direction at the front end portion of the second upper blade main body 22*a* is disposed in the sliding face of the second upper blade main body 22*a* as well as the guide groove 22*g* and the first concave groove 22*h*. The second concave groove 22*i* is provided to mold the second upper blade main body 22*a* into a predetermined shape using a mold.

Fitting holes 32 for fitting the pin 7 which supports the locking pawl 5 are formed in the top end portion of the connecting post 24 of the slider body 2 as well as the pawl accommodating groove 29. Further, an accommodating hole 33 for accommodating the resilient member 6 is bored in the lower end portion of the connecting post 24 such that it is directed backward from the second accommodating groove 29*b*.

As shown in FIG. 5, the accommodating hole 33 for the resilient member 6 is disposed above the inner face of the lower blade 23 (on the side of the upper blade 20). Thus, the thickness from the lower face (external face) of the lower blade 23 of the slider body 2 to the accommodating hole 33 is secured appropriately so as to intensify the strengths of the lower blade 23 and the connecting post 24. Further, because the second bottom face portion 31*b* of the pawl accommodating groove 29 is disposed at the same height position as the rotation shaft center of the locking pawl 5 or above the rotation shaft center as described above, the thickness from the bottom face portion 31 of the pawl accommodating groove 29 to the accommodating hole 33 can be secured appropriately so as to intensify the strength of the connecting post 24.

An attaching groove 34 to which the holding tongue piece 22*f* disposed on the second upper blade 22 is attached slidably is provided concavely in the back and forth direction in the lower face of the lower blade 23 of the slider body 2. The groove depth of the attaching groove 34 is set corresponding to the dimension in the vertical direction of the holding tongue piece 22*f* so that when the holding tongue piece 22*f* is attached, the lower face of the lower blade 23 which configures the lower face of the slider body 2 and the lower face of the holding tongue piece 22*f* are in a flat plane. The flat plane mentioned here includes not only a case where the bottom face of the lower blade 23 and the lower face of the holding tongue piece 22*f* are formed into an identical flat face but also a case where there exists a slight gap (gap of about several mm) between the lower face of the lower blade 23 and the lower face of the holding tongue piece 22*f*.

A raised portion 23*a* is provided on part of the inner face of the lower blade 23 in order to arrange the posture of the fastener elements when element rows are passed through the element guide passage 27.

The tab 4 of the first embodiment has a tab main body portion 41 and right and left arm portions 42 extending from both the right and left sides of the tab main body portion 41. A fitting hole 43 in which the tab attaching portion 22*b* of the second upper blade 22 is to be fitted is formed at the front end portion of each of the arm portions 42. The tab 4 is attached to the tab attaching portions 22*b* of the second upper blade 22 by fitting the tab attaching portion 22*b* of the second upper blade 22 into the fitting holes 43 in the arm portions 42 so as to pivot the tab 4 on the slider body 2. According to the present invention, it is permissible to provide a cylindrical convex portion at the front end of each of the right and left arm portions 42 of the tab 4 and form the fitting holes in which the convex portion can be fitted in both the right and left side portions of the second upper blade 22 as each tab attaching portion, so that the tab 4 can be pivoted on the slider body 2.

The locking pawl 5 of the first embodiment has a pawl lever portion 52 extending from a journaling portion 51 in which the pin 7 is to be inserted, a first projecting piece 53 disposed on the bottom of the journaling portion 51 and a second projecting portion 54 disposed on the top of the journaling portion 51, thereby providing a substantially T-like shape when viewed from the side. A pawl portion 55 which can be inserted into/pulled out from the element guide passage 27 of the slider body 2 is provided projectingly at the rear end portion of the pawl lever portion 52 of the locking pawl 5. The pawl lever portion 52 has a declined slope portion 56 corresponding to the declined slope face disposed in the pawl accommodating groove 29 between the journaling portion 51 and the pawl portion 55. The declined slope portion 56 is a portion where both upper and lower surfaces of the pawl lever portion 52 are declined so as to correspond to the declined surface of the pawl accommodating groove 29.

The first projecting piece 53 is formed such that it is narrowed toward its front end when viewed from the side. The first projecting piece 53 has a contact portion which the resilient member 6 accommodated in the connecting post 24 is brought into contact with on the rear face side of the first projecting piece 53 and further has a contact portion which the first operating portion 22*d* of the second upper blade 22 is brought into contact with on the front face side of the first projecting piece 53, when the locking pawl 5 is journaled by the slider body 2. The second projecting piece 54 is formed into a substantially rectangular shape when viewed from the side and has a contact portion which the second operating portion 22*e* of the second upper blade 22 is brought into contact with when the locking pawl 5 is journaled by the slider body 2, on its rear face side.

The resilient member 6 of the first embodiment is configured of a coil-like spring generally used since conventionally.

When the thin slider 1 having the above-described components of the first embodiment is assembled, first, the resilient member 6 is accommodated in the accommodating hole 33 formed in the connecting post 24 of the slider body 2. Further, the locking pawl 5 is inserted and held in the pawl accommodating groove 29 in the slider body 2. At this time, the locking pawl 5 inserted into the pawl accommodating groove 29 is held such that it is tilted forward so that the top end of the second projecting piece 54 of the locking pawl 5 and the top end of the pawl lever portion 52 are at the same height position in the vertical direction.

Next, with the guide groove 22*g* in the second upper blade 22 aligned with the position of the guide portion 28 on the first upper blade 21, the second upper blade 22 is slid backward from the front end side of the first upper blade 21. Consequently, with the guide portion 28 of the first upper blade 21 attached to the guide groove 22*g* of the second upper blade 22, the second upper blade 22 can be attached to the first upper blade 21 slidably in the back and forth direction. Particularly, in the thin slider 1 of this embodiment, by attaching the guide portion 28 of the first upper blade 21 to the guide groove 22*g* in the second upper blade 22, the holding tongue piece 22*f* of the second upper blade 22 can be attached to an attaching groove 34 provided concavely in the lower blade 23 so as to stabilize the attaching state of the second upper blade 22.

When the second upper blade 22 is slid backward to be attached to the first upper blade 21, the locking pawl 5 held in a forward tilted state within the pawl accommodating groove 29 in the slider body 2 is pressed backward by the first operating portion 22*d* of the second upper blade 22. Consequently, as shown in FIG. 5, the locking pawl 5 is held in such a manner that the pawl portion 55 is inserted into the element guide passage 27 so that the front face of the first projecting piece 53 makes contact with the first operating portion 22*d* of the second upper blade 22 and the rear face of the first projecting piece 53 is urged by the resilient member 6.

After that, the pin 7 is inserted into the fitting holes 32 formed in the connecting post 24 of the slider body 2 so as to journal the locking pawl 5 by the slider body 2. Further, the arm portions 42 of the tab 4 are attached rotatably to the tab attaching portion 22*b* provided on the second upper blade 22. Consequently, the thin slider 1 of the first embodiment can be assembled, the thin slider 1 having an excellent design property and being equipped with an automatic locking mechanism by means of the locking pawl 5.

By passing the thin slider 1 of the first embodiment obtained in this way through the element rows 9 of a fastener stringer 8 as shown in FIG. 1, the slide fastener 10 is configured. By sliding the thin slider 1 on the element rows 9, the right and left element rows 9 can be coupled or decoupled.

Particularly, because the thin slider 1 of the first embodiment has the automatic locking mechanism by the locking pawl 5, the first projecting piece 53 of the locking pawl 5 is urged in such a first rotation direction that the pawl portion 55 of the locking pawl 5 is inserted into the element guide passage 27 as shown in FIG. 5 when the tab 4 is not operated. Thus, the pawl portion 55 of the locking pawl 5 is projected into the element guide passage 27 via the pawl hole 30 and engaged with the element rows 9 passed through the element guide passage 27. Consequently, the thin slider 1 can be held stably at a locking position on the element rows 9.

Particularly, in the thin slider 1 of the first embodiment, the locking pawl 5 is supported by the bottom face portion 31 (fourth bottom face portion 31*d*) of the pawl accommodating groove 29 at a position on the rear mouth side with respect to the connecting post 24 when the pawl portion 55 of the locking pawl 5 is inserted into the element guide passage 27. As a result, the posture of the locking pawl 5 is stabilized so that the insertion position of the pawl portion 55 into the element guide passage 27 is stabilized, thereby holding the thin slider 1 securely at the locking position.

By stabilizing the posture of the locking pawl 5 in a state that the thin slider 1 is locked, the first projecting piece 53 and the second projecting piece 54 of the locking pawl 5 can be pressed securely by means of the first operating portion 22*d* or the second operating portion 22*e* of the second upper blade 22 when the tab 4 is operated to slide the thin slider 1 as described later. Consequently, the pawl portion 55 can be pulled out of the element guide passage 27 smoothly.

Figure 7:
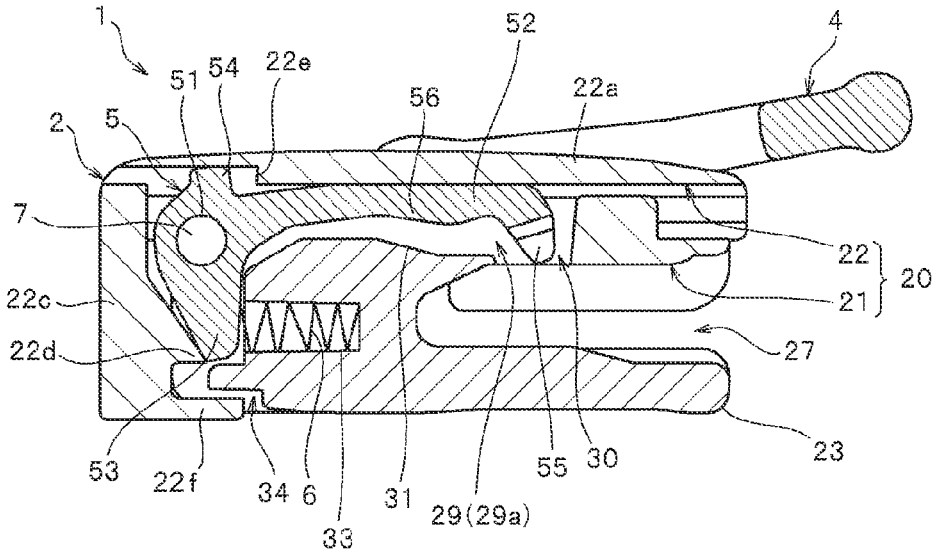
FIG. 7 is a longitudinal sectional view showing a state in which the thin slider is slid in a direction for separating element rows.

Next, to slide the thin slider 1 in a direction of separating the right and left element rows 9 from a state that it is locked on the element rows 9, user operates the tab 4 by pulling the tab 4 backward. When the tab 4 is pulled backward of the slider, a force applied to the tab 4 acts directly on the second upper blade 22, so that the second upper blade 22 is slid backward with respect to the first upper blade 21 as shown in FIG. 7.

Consequently, the first operating portion 22*d* of the second upper blade 22 presses the first projecting piece 53 of the locking pawl 5 resisting the urging force of the resilient member 6 so as to rotate the locking pawl 5 in a second rotation direction for pulling out the pawl portion 55 out of the element guide passage 27. As a result, the pawl portion 55 of the locking pawl 5 is pulled out of the element guide passage 27 so as to release the engaging state between the pawl portion 55 and the element rows 9. Consequently, the thin slider 1 can be slid smoothly in a direction for separating the element rows 9 (backward of the slider).

In this case, in the slider of the first embodiment, the declined slope face (third bottom face portion 31*c*) which is declined toward the pawl hole 30 is disposed on the bottom face portion 31 of the pawl accommodating groove 29 formed in the slider body 2. At the same time, the declined slope portion 56 is formed on the pawl lever portion 52 of the locking pawl 5. Furthermore, in the declined slope portion 56, both the upper and lower surfaces of the pawl lever portion 52 are formed so as to decline. As a result, even if the second bottom face portion 31*b* of the pawl accommodating groove 29 is disposed at the same height position as the rotation shaft center of the locking pawl 5 or above the same rotation shaft center as described previously in order to secure the strengths of the connecting post 24, a stable rotation range of the locking pawl 5 can be secured within the slider body 2.

In the thin slider 1 of the first embodiment, the first concave groove 22*h* which is parallel to the guide groove 22*g* and narrower than the opening portion of the guide groove 22*g* is provided concavely in the sliding face of the second upper blade main body 22*a*. Thus, by using a space in the first concave groove 22*h*, a large rotation range for the locking pawl 5 can be secured within the slider body 2 while maintaining strength of the second upper blade main body 22*a*. Thus, by sliding the second upper blade 22 backward with respect to the first upper blade 21 in the thin slider 1, the locking pawl 5 can be rotated stably in the second rotation direction with the rotation range formed in the slider body 2. Consequently, the pawl portion 55 of the locking pawl 5 can be pulled out of the element guide passage 27 securely so as to enable the thin slider 1 to slide smoothly.

If the thin slider 1 is slid to a predetermined position along the element rows 9 and the operation of the tab 4 is released to lock the thin slider 1, the locking pawl 5 is urged by the resilient member 6 and rotated in the first rotation direction. As a result, the first projecting piece 53 of the locking pawl 5 presses the first operating portion 22*d* of the second upper blade 22, so that the second upper blade 22 is slid forward and returned to its original position. Then, the pawl portion 55 is inserted into the element guide passage 27 and engaged with the element rows 9. Consequently, the thin slider 1 can be held stably at the locking position.

Figure 8:
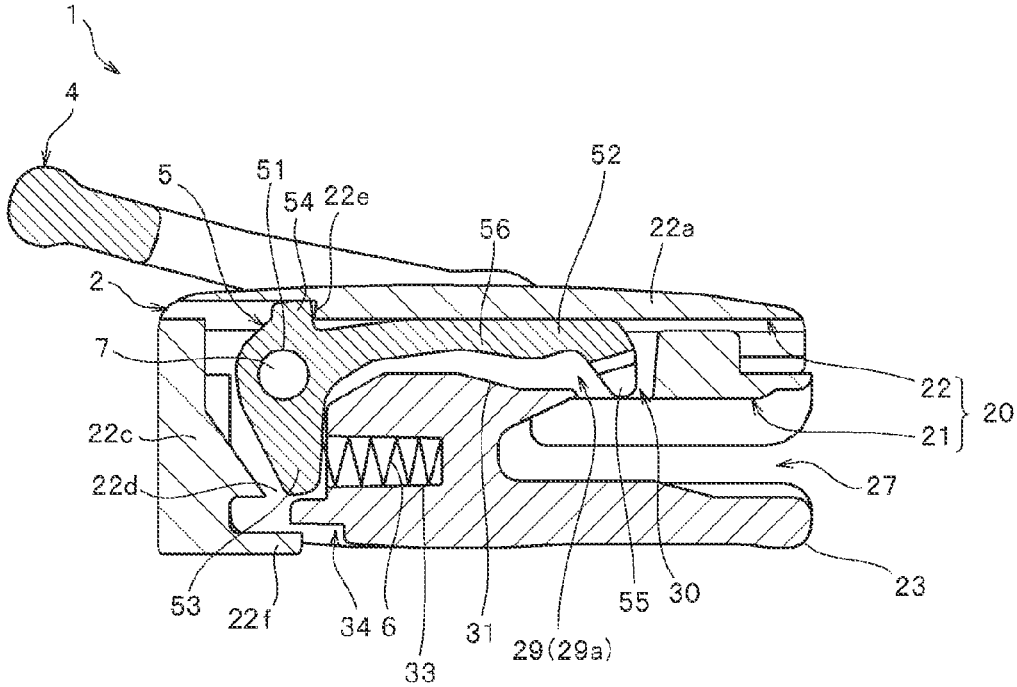
FIG. 8 is a longitudinal sectional view showing a state in which the thin slider is slid in a direction for coupling the element rows.

On the other hand, to slide the thin slider 1 in a direction for coupling the right and left element rows 9 from a state in which the slider 1 is locked, user operates the tab 4 by pulling the tab 4 forward of the slider. When the tab 4 is pulled forward of the slider, a force applied to the tab 4 acts directly on the second upper blade 22, so that as shown in FIG. 8, the second upper blade 22 is slid forward with respect to the first upper blade 21.

Consequently, the second operating portion 22*e* of the second upper blade 22 presses the second projecting piece 54 of the locking pawl 5 resisting the urging force of the resilient member 6 so as to rotate the locking pawl 5 in the second rotation direction for pulling the pawl portion 55 out of the element guide passage 27 as described above. As a result, the pawl portion 55 of the locking pawl 5 is pulled out of the element guide passage 27, so that the thin slider 1 can be slid easily in a direction for coupling the element rows 9 (forward of the slider).

As described above, the thin slider 1 of the first embodiment has a small thickness in the vertical direction, an excellent design property, and an excellent operability. Additionally, the thin slider is used as a slider for a slide fastener having the automatic locking mechanism by the locking pawl 5.

Second Embodiment

Figure 9:
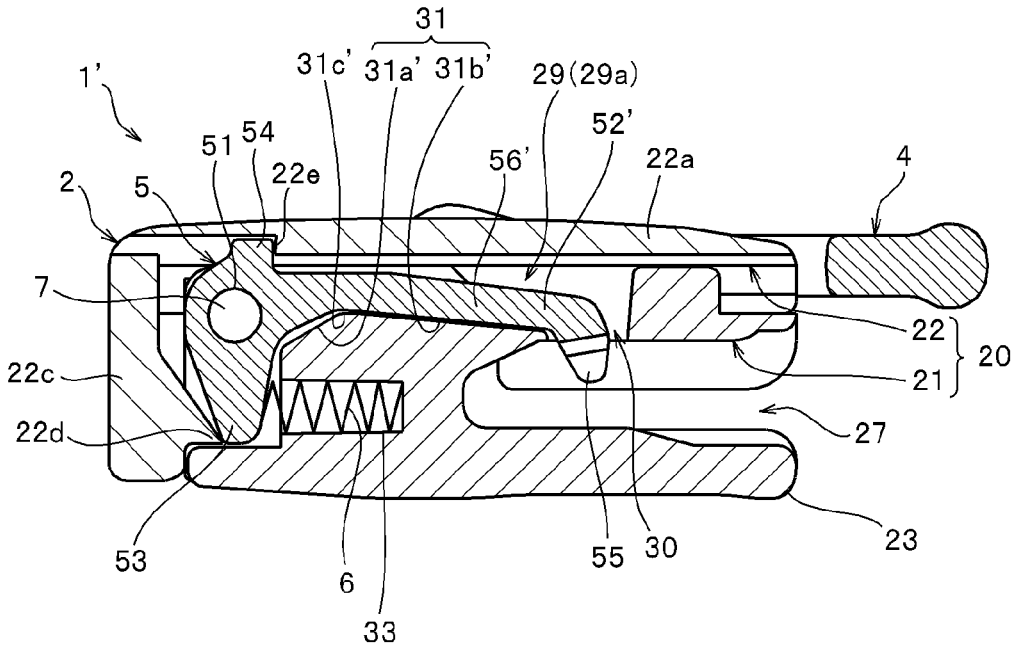
FIG. 9 is a longitudinal sectional view showing a state in which a tab of a thin slider of a second embodiment is not operated.
Figure 10:
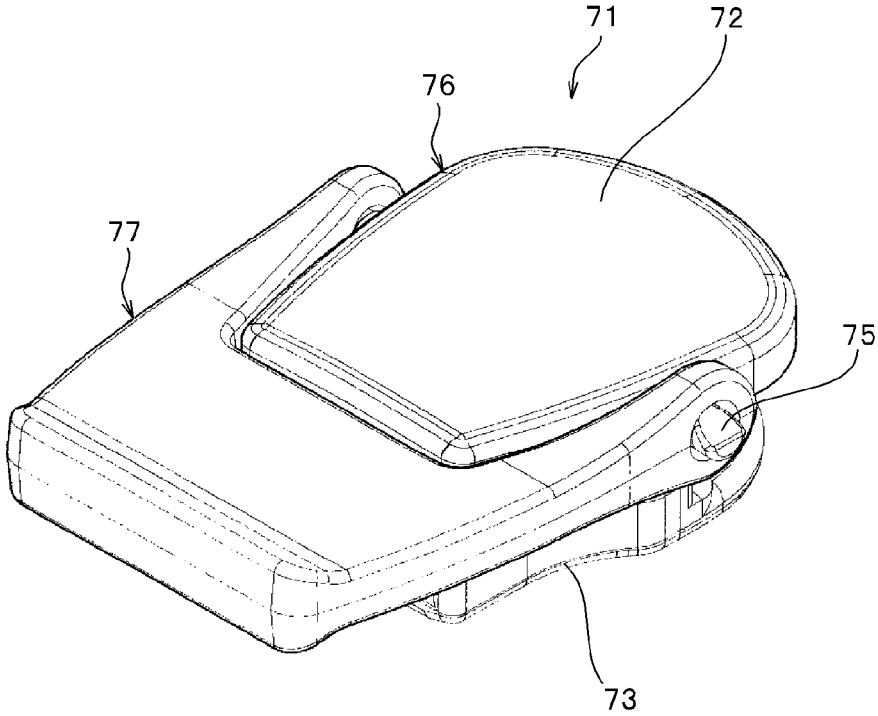
FIG. 10 PRIOR ART
FIG. 10 is a perspective view showing a conventional thin slider.
Figure 11:
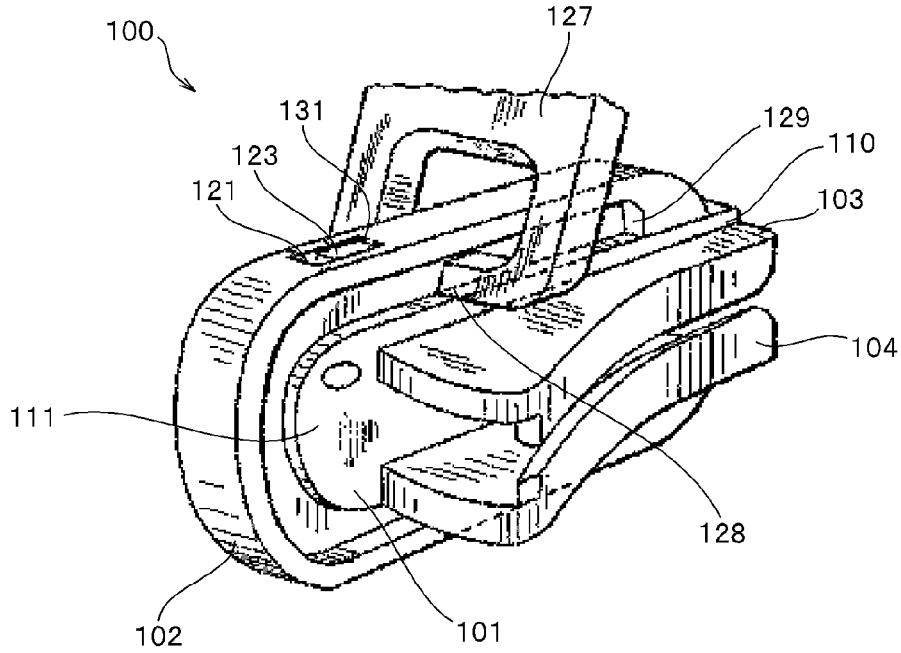
FIG. 11 PRIOR ART
FIG. 11 is a perspective view showing a slider having a conventional automatic locking mechanism.
Figure 12:
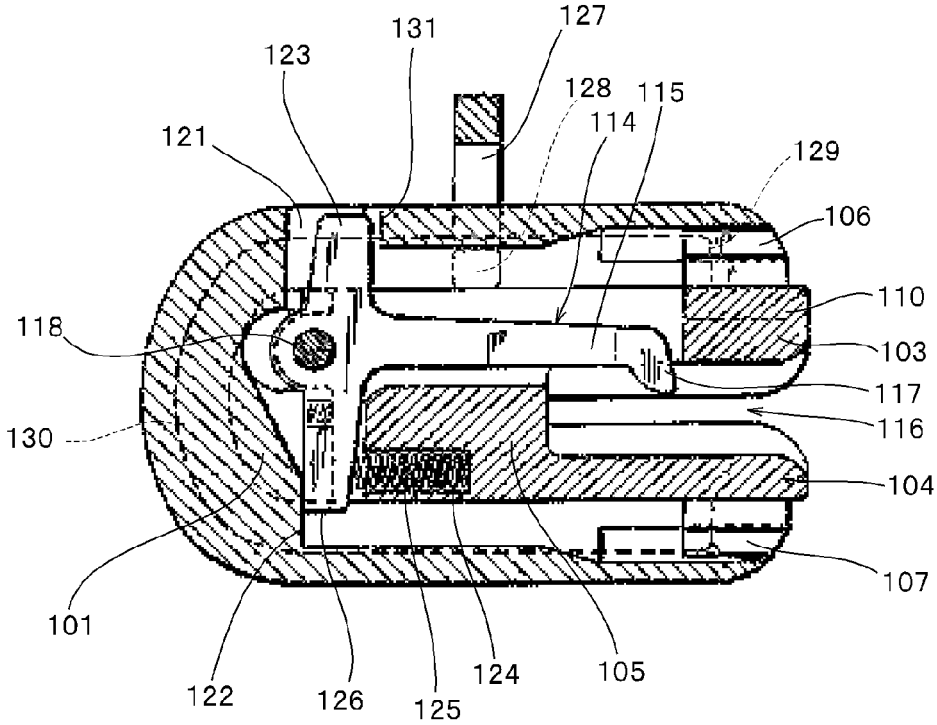
FIG. 12 PRIOR ART
FIG. 12 is a longitudinal sectional view of the slider.

FIG. 9 is a longitudinal sectional view showing a state that a tab of a thin slider of a second embodiment is not operated.

The thin slider 1' of the second embodiment has a different configuration in the bottom face portion 31' of the pawl accommodating groove 29 disposed on the slider body 2, the pawl lever portion 52' of the locking pawl 5 and the lower face portion of the slider body 2 from the thin slider 1 of the first embodiment. The other configurations are substantially equal to the thin slider 1 of the first embodiment. Therefore, components and members of the second embodiment, having the same configuration as the thin slider 1 of the first embodiment are denoted with like reference numerals and description of those components and members is omitted.

The slider body 2 of the second embodiment has an upper blade 20, a lower blade 23 and a connecting post 24 for connecting between the front end portions of the upper and lower blades 20, 23. The upper blade 20 of the slider body 2 has a first upper blade 21 connected to the connecting post 24 and a second upper blade 22 attached slidably onto the first upper blade 21.

The second upper blade 22 has a thin second upper blade main body 22*a* disposed on the top face of the first upper blade 21, tab attaching portions (not shown in FIG. 9) projecting from the right and left side faces of the second upper blade main body 22*a* and an operating piece 22*c* drooping from the front end portion of the second upper blade main body 22*a*. However, according to the second embodiment, the second upper blade 22 has no holding tongue piece 22*f* extending backward from the lower end of the operating piece 22*c* and no attaching groove 34 as indicated in the first embodiment is disposed on the lower face of the lower blade 23.

Although the slider body 2 of the second embodiment is provided with no holding tongue piece 22*f* or attaching groove 34 of the first embodiment, the guide portion 28 (not shown in FIG. 9) which is the same as in the first embodiment is disposed on the top face of the first upper blade 21 and a guide groove 22*g* (not shown in FIG. 9) to which the guide portion 28 can be attached is disposed on the lower face (sliding face) of the second upper blade 22. Thus, the second upper blade 22 can be attached slidably to the first upper blade 21.

A pawl accommodating groove 29 for accommodating and holding the locking pawl 5 is provided concavely in the first upper blade 21 and the connecting post 24 of the slider body 2 of the second embodiment, and the pawl accommodating groove 29 has a first accommodating groove 29*a* formed along the back and forth direction and a second accommodating groove 29*b* formed at the front end portion of the first upper blade 21 in the vertical direction.

In this case, the bottom face portion 31' of the first accommodating groove 29*a* is provided such that it is bent continuously from the second accommodating groove 29*b* up to the pawl hole 30 and the bottom face portion 31' is extended up to a position on the rear mouth side relative to the rear end of the connecting post 24. The bottom face portion 31' of the first accommodating groove 29*a* has a first bottom face portion 31*a*' formed of an inclined slope face which inclines from the second accommodating groove 29*b* toward the rear mouth slope side and a second bottom face portion 31*b*' formed of a declined face which is declined from the rear end of the first bottom face portion 31*a*' toward the rear mouth side. Further, a bent portion 31*c*' disposed between the first bottom face portion 31*a*' and the second bottom face portion 31*b*' is disposed at the same height position as the rotation shaft center of the locking pawl 5 or above the rotation shaft center. Consequently, the thickness from the bottom face portion 31' of the pawl accommodating groove 29 to the accommodating hole 33 is secured appropriately, thereby intensifying the strength of the connecting post 24.

The locking pawl 5 of the second embodiment has a pawl lever portion 52' extending backward from the journaling portion 51, a first projecting piece 53 disposed downward of the journaling portion 51 and a second projecting piece 54 disposed above the journaling portion 51. The pawl lever portion 52' has a declined slope portion 56' corresponding to the declined slope face of the second bottom face portion 31*b*, and the declined slope portion 56' of the pawl lever portion 52' is formed longer than the pawl lever portion 52 of the first embodiment.

Like the second embodiment, the declined slope face (second bottom face portion 31*b*') is disposed on the bottom face portion 31' of the pawl accommodating groove 29 of the slider body 2, and the long declined slope portion 56' is formed in the pawl lever portion 52' of the locking pawl 5, so as to secure a rotation range of the locking pawl 5 within the slider body 2 stably. Therefore, when the locking pawl 5 is pressed by the first operating portion 22*d* or the second operating portion 22*e* of the second upper blade 22, the locking pawl 5 is rotated stably in the second rotation direction so that the pawl portion 55 is pulled out of the element guide passage 27, thereby pulling the pawl portion 55 of the locking pawl 5 out of the element guide passage 27 securely.

The thin slider 1' of the second embodiment has an excellent design property and operability like the thin slider 1 of the first embodiment and is used as a slider for a slide fastener equipped with the automatic locking mechanism by the locking pawl 5.

What is claimed is:

1. A thin slider for a slide fastener comprising:

a slider body in which front end portions of upper and lower blades are connected by a connecting post, a Y-shaped element guide passage is provided between the upper and lower blades and a tab attaching portion is disposed on each of the right and left side faces of the upper blade;

a tab having an arm portion pivotably fixed to the right and left tab attaching portions and a tab main body formed integrally with the arm portion;

a locking pawl which is journaled by the slider body; and a resilient member accommodated in the connecting post, wherein the locking pawl comprises a pawl lever portion which is extended backward from a journaling portion which serves as a rotation shaft and in which a pawl portion capable of being inserted into and pulled out of the element guide passage are provided projectingly at a rear end portion thereof; a first projecting piece disposed below the journaling portion; and a second projecting piece disposed above the journaling portion, the first projecting piece being urged in a first rotation direction for inserting the pawl portion into the element guide passage by the resilient member, wherein the upper blade is connected to the connecting post and comprises a first upper blade having a guide portion disposed on a top face thereof in a back and forth direction and a second upper blade which is attached slidably to the first upper blade along the guide portion, wherein the second upper blade comprises a second upper blade main body in a thin plate shape disposed on the top face of the first upper blade and an operating piece drooping from a front end portion of the second upper blade main body along the connecting post, wherein a first operating portion for pressing the first projecting piece in a second rotation direction for pulling the pawl portion out of the element guide passage when the second upper blade is slid backward is disposed on an inner face of the operating piece, and a second operating portion for pressing the second projecting piece in the second rotation direction when the second upper blade is slid forward is disposed on a side of a sliding face of the second upper blade main body and wherein the second upper blade main body is equal to or larger than the first upper blade.

2. The thin slider according to claim 1, wherein the resilient member is disposed above an inner face of the lower blade.

3. The thin slider according to claim 1, wherein the slider body comprises: a pawl accommodating groove which is provided concavely in a top face of the first upper blade so as to accommodate the locking pawl; and a pawl hole which is bored in a rear end of the pawl accommodating groove so as to allow the pawl portion to pass through, a bottom face portion of the pawl accommodating groove having a declined face which is declined toward the pawl hole.

4. The thin slider according to claim 3, wherein a height position in a vertical direction of part of the bottom face portion is at a same height position as a rotation shaft center of the locking pawl or at a height position above the rotation shaft center.

5. The thin slider according to claim 3, wherein the locking pawl has a declined slope portion corresponding to the declined slope face of the pawl accommodating groove.

6. The thin slider according to claim 3, wherein the bottom face portion of the pawl accommodating groove is extended toward a rear mouth with respect to the connecting post.

7. The thin slider according to claim 1, wherein a lower face of the slider body is formed in a flat plane.

8. The thin slider according to claim 1, wherein the second upper blade has a holding tongue extended backward from a lower end of the operating piece, and an attaching groove to which the holding tongue is attached slidably is provided concavely in a lower face of the lower blade.

9. The thin slider according to claim 1, wherein the guide portion comprises: a proximal portion erected from a top face of the first upper blade and an engaging piece extended outward in a right and left direction from a top end of the proximal portion, and a bottom face of the second upper blade contains a guide groove having a T-shaped section along a back and forth direction thereof, the guide groove allowing the guide portion to be attached thereto.

10. The thin slider according to claim 9, wherein a concave groove parallel to the guide groove is provided concavely in a groove bottom face portion of the guide groove.

* * * * *